US006970133B2

(12) United States Patent
Chandler

(10) Patent No.: US 6,970,133 B2
(45) Date of Patent: Nov. 29, 2005

(54) ANTENNA SYSTEM AND METHOD OF USING SAME

(75) Inventor: Cole A. Chandler, Weatherford, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 138 days.

(21) Appl. No.: 10/454,334

(22) Filed: Jun. 4, 2003

(65) Prior Publication Data

US 2004/0246183 A1 Dec. 9, 2004

(51) Int. Cl.[7] ..... H01Q 1/38
(52) U.S. Cl. ..... 343/700 MS; 343/893
(58) Field of Search ..... 343/700 MS, 767, 343/769, 770, 893

(56) References Cited

U.S. PATENT DOCUMENTS

| | | | | |
|---|---|---|---|---|
| 3,842,417 A | | 10/1974 | Williams | 343/5 |
| 3,978,482 A | | 8/1976 | Williams et al. | 343/100 |
| 5,537,367 A | | 7/1996 | Lockwood et al. | 367/87 |
| 5,847,675 A | | 12/1998 | Poinsard | 342/81 |
| 6,067,048 A | | 5/2000 | Yamada | 342/382 |
| 6,098,547 A | * | 8/2000 | West | 102/214 |
| 6,175,333 B1 | * | 1/2001 | Smith et al. | 343/700 MS |
| 6,246,359 B1 | | 6/2001 | Asano et al. | 342/158 |
| 6,304,214 B1 | | 10/2001 | Aiken et al. | 342/362 |
| 6,335,700 B1 | | 1/2002 | Ashihara | 342/70 |
| 6,473,040 B1 | * | 10/2002 | Nakamura | 343/700 MS |

FOREIGN PATENT DOCUMENTS

| | | | |
|---|---|---|---|
| JP | WO99/34234 | 7/1999 | G01S/13/44 |

* cited by examiner

*Primary Examiner*—Shih-Chao Chen
(74) *Attorney, Agent, or Firm*—Williams, Morgan & Amerson, P.C.

(57) ABSTRACT

An antenna system includes a plurality of transmit elements spaced apart by a first dimension and a plurality of receive elements spaced apart by a second dimension, such that the first dimension is a non-integer multiple of the second dimension and the second dimension is a non-integer multiple of the first dimension. A method includes transmitting a signal from a plurality of transmit elements spaced apart by a first dimension and receiving a portion of the transmitted signal reflected from an object via a plurality of receive elements spaced apart by a second dimension, such that the first dimension is a non-integer multiple of the first dimension and second dimension is a non-integer multiple of the first dimension.

41 Claims, 8 Drawing Sheets

ANTENNA SYSTEM AND METHOD OF USING SAME

BACKGROUND OF THE INVENTION

1. Field of the Invention

This invention relates to antenna systems and, in particular, to an antenna system capable of suppressing grating lobes.

2. Description of the Related Art

Radar and other electronic systems often use antenna arrays to transmit and/or receive electronic signals in a particular direction or range of directions. As illustrated in FIG. 1A, such an antenna array 100 may comprise a backplane 101 on which a plurality of antenna elements 102 are disposed in a spaced-apart fashion by a dimension A in an orthogonal grid pattern. The antenna elements 102 may be used to transmit or receive, or both, depending on the implementation. Generally, electromagnetic signals are transmitted from and received by some or all of the antenna elements 102. In radar applications, as illustrated in FIG. 1B, for example, electromagnetic signals (represented by arrows 104) are transmitted from the array 100. Some of the signals encounter an object 106 and a portion of the signals (represented by an arrow 108) is reflected back toward the array 100, where it is received.

FIG. 1C illustrates a typical graphical representation 110 of the electromagnetic signals received by an array, such as the array 100. The electromagnetic signals, e.g., the signals 108, reflected by an object, such as the object 106, appear as a target feature 112 in the representation 110. However, when the elements 102 are spaced apart such that the dimension A is generally equal to or greater than about one-half of the wavelength of the signals being transmitted, signals transmitted from adjacent elements 102 may interfere with one another, resulting in an electromagnetic phenomenon known as a "grating lobe." Such a grating lobe may appear as an anomalous feature 114 in the representation 110 and may be incorrectly interpreted as signals reflected from an object.

Various approaches have been developed to overcome this problem. For example, multiple transmit/receive cycles may be performed using signals of different frequencies. Typically, the anomalous feature 114 may be disposed in various locations in the representation 110 depending upon the frequency used, or the anomalous feature 114 may disappear from the representation 110 when some frequencies are used. Such approaches require additional time to process the information and, thus, may not be appropriate depending upon the application.

Another approach to reduce the occurrence of anomalous features 114 has been to decrease the spacing between the antenna elements 102, as shown in FIG. 2A. In the illustrated array 200, the antenna elements 102 are disposed on a backplane 201 in a spaced-apart fashion such that a dimension B is less than about one-half of the wavelength of the electromagnetic signals transmitted by the antenna elements 102. FIG. 2B illustrates a graphical representation 202 of signals received by the array 200. In the representation 202, the electromagnetic signals, e.g., the signal 108, reflected by an object, such as the object 106 of FIG. 1B, appear as a target feature 204. However, no anomalous feature, such as the anomalous feature 114 of FIG. 1C, appears in the representation 202.

While the approach illustrated in FIGS. 2A and 2B is generally effective, the cost of the array 200 may be substantially greater than that of the array 100, since more antenna elements 102 are required for a given array area. Further, in general, each of the antenna elements 102 is electrically connected to a transceiver (not shown). As the density of the antenna elements 102, and thus the transceivers, increases, there may be insufficient room to connect the antenna elements 102 to the transceivers or to attach the transceivers to the backplane 201.

The present invention is directed to overcoming, or at least reducing, the effects of one or more of the problems set forth above.

SUMMARY OF THE INVENTION

In one aspect of the present invention, an antenna system is provided. The antenna system includes a plurality of transmit elements spaced apart by a first dimension and a plurality of receive elements spaced apart by a second dimension, such that the first dimension is a non-integer multiple of the second dimension and the second dimension is a non-integer multiple of the first dimension.

In another aspect of the present invention, an antenna system is provided. The antenna system includes a plurality of transmit elements spaced apart in a grid by a first dimension and a plurality of receive elements spaced apart in a grid by a second dimension. The first dimension is a non-integer multiple of the second dimension, the second dimension is a non-integer multiple of the first dimension, and the grid of the plurality of transmit elements is rotated with respect to the grid of the plurality of receive elements.

In yet another aspect of the present invention, an antenna system is provided. The antenna system includes a plurality of transmit elements spaced apart in a grid by a first dimension and a plurality of receive elements spaced apart in a grid by a second dimension, such that the first dimension is a non-integer multiple of the second dimension and the second dimension is a non-integer multiple of the first dimension. The antenna system further includes a transceiver element disposed proximate an intersection of the grid of the plurality of transmit elements and the grid of the plurality of receive elements.

In another aspect of the present invention, a projectile is provided. The projectile includes a body and an antenna system disposed in the body. The antenna system includes a plurality of transmit elements spaced apart by a first dimension and a plurality of receive elements spaced apart by a second dimension, such that the first dimension is a non-integer multiple of the second dimension and the second dimension is a non-integer multiple of the first dimension.

In yet another aspect of the present invention, a method is provided. The method includes transmitting a signal from a plurality of transmit elements spaced apart by a first dimension and receiving a portion of the transmitted signal reflected from an object via a plurality of receive elements spaced apart by a second dimension, such that the first dimension is a non-integer multiple of the first dimension and the second dimension is a non-integer multiple of the first dimension.

In another aspect of the present invention, an antenna system is provided. The antenna system includes a plurality of transmit elements spaced apart in a first grid and a plurality of receive elements spaced apart in a second grid, such that a convolution of the first grid and the second grid produces an aperiodic pattern.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which.

Figure 1A:
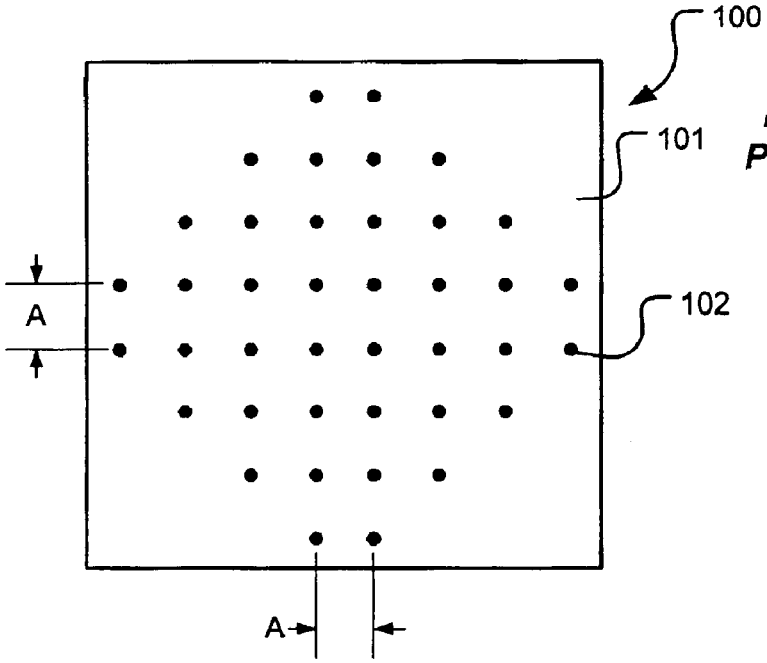
FIG. 1A PRIOR ART
FIG. 1A is a stylized top plan view of a first conventional antenna array.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

Figure 3A:
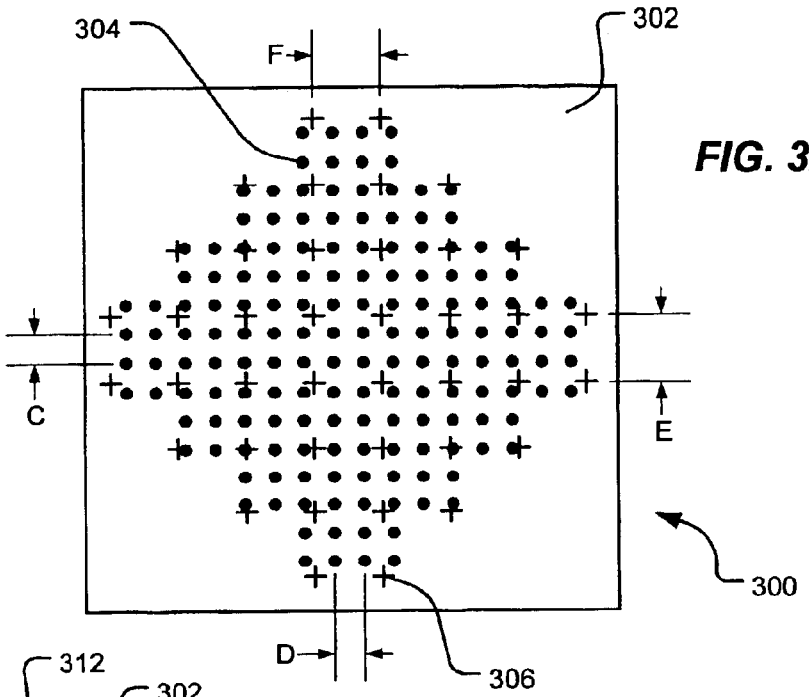
FIG. 3A is a stylized top plan view of a first illustrative embodiment of an antenna system according to the present invention.

FIG. 3A is a stylized diagram of a first illustrative embodiment of an antenna system 300 according to the present invention. The antenna system 300 includes a backplane 302, a plurality of transmit elements 304 (only one labeled for clarity), and a plurality of receive elements 306 (only one labeled for clarity). While the elements 306, 304 are illustrated in FIG. 3A as being disposed on the backplane 302 in a particular perimeter geometry, the present invention is not so limited. Rather, the perimeter geometry of the elements 306, 304 may take on any chosen form.

Figure 3B:
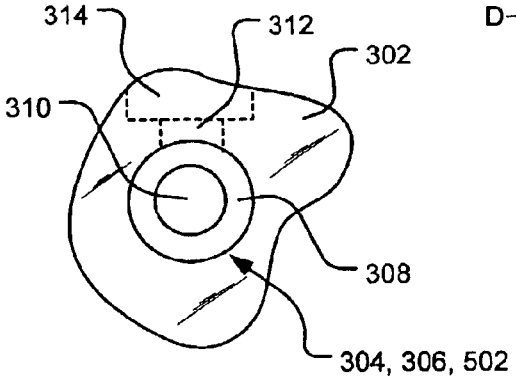
FIG. 3B is a top plan view of a transmit element or a receive element of FIG. 3A.

Concerning the form of the elements 306, 304, in the embodiment illustrated in FIG. 3B, at least one of the elements 304, 306 comprise a ring 308 surrounding an opening 310 defined by the backplane 302. The ring 308 comprises an electrically conductive material, such as aluminum, copper, silver, gold, or the like. The elements 304, 306 may, however, take on other forms rather than that depicted in FIG. 3B. The ring 308 is electrically coupled by a lead 312 to a module 314, which comprises a transmitter if the ring 308 is to transmit electromagnetic signals and comprises a receiver if the ring 308 is to receive electromagnetic signals, as are known in the art. Alternatively, the elements 304, 306 may comprise waveguide slots, microstrips, or other such structures known to the art. The configuration of the elements 304, 306 is not pertinent to the practice of the invention.

Referring again to FIG. 3A, the transmit elements 304 are arranged in a generally orthogonal grid pattern having a first spacing C and a second spacing D. In other embodiments, the grid pattern may be rectangular, triangular, or the like. In one embodiment, the first spacing C generally corresponds to the second spacing D. The present invention, however, is not so limited. Rather, in various embodiments the first spacing C may be different than, i.e., greater than or less than, the second spacing D. Further, the receive elements 306 are arranged in a generally orthogonal grid pattern having a first spacing E and a second spacing F. As in the transmit elements 304, the first spacing E may generally correspond to the second spacing F or may be different from the second spacing F.

While the spacings C, D of the transmit elements 304 are illustrated in FIG. 3A as being less than the spacings E, F of the receive elements 306, the present invention is not so limited. Rather, the scope of the present invention encompasses embodiments wherein the spacings C, D of the transmit elements 304 are greater than the spacings E, F of the receive elements 306. In any case, the spacings C, D of the transmit elements 304 are non-integer multiples of each of the spacings E, F of the receive elements 306 and the spacings E, F of the receive elements 306 are non-integer multiples of each of the spacings C, D of the transmit elements 304. For example, if the spacings C, D of the transmit elements 304 is 10 mm, the spacings E, F cannot be 0.25 mm, 0.5 mm, 10 mm, 20 mm, and so forth. In other words, the result of convolving the grid of the transmit elements 304 and the grid of the receive elements 306 is an aperiodic pattern.

Figure 1B:
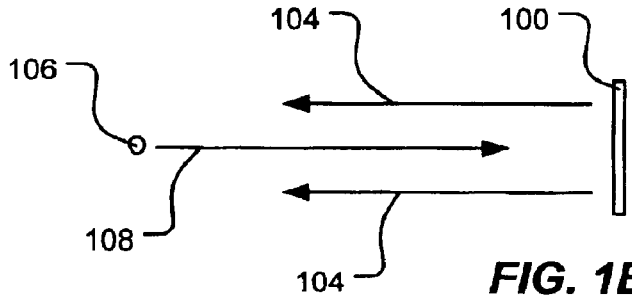
FIG. 1B PRIOR ART
FIG. 1B is a stylized diagram of the array of FIG. 1A in a radar application.
Figure 1C:
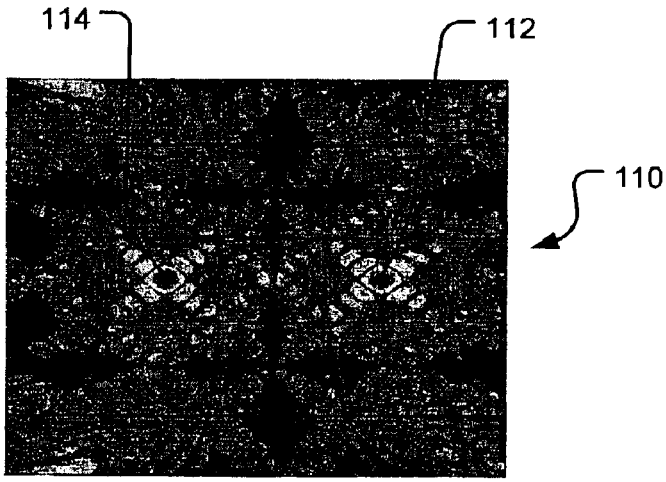
FIG. 1C PRIOR ART
FIG. 1C is an exemplary graphical representation of signals received by the array of FIG. 1A.
Figure 2A:
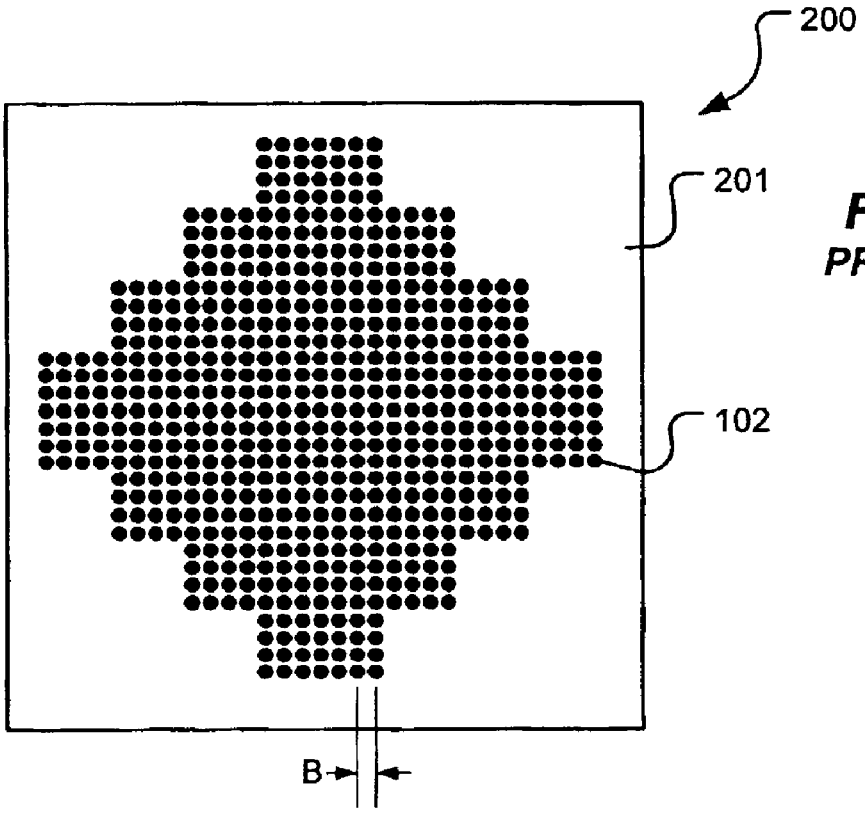
FIG. 2A PRIOR ART
FIG. 2A is a stylized top plan view of a second conventional antenna array.
Figure 2B:
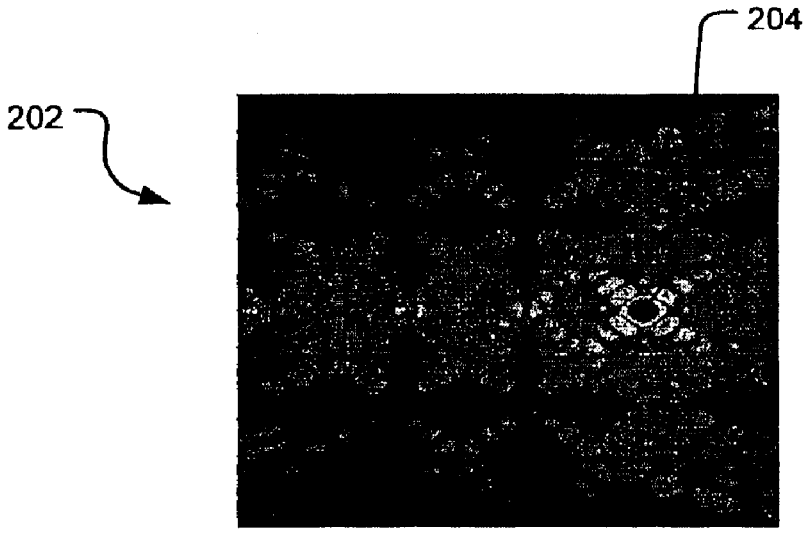
FIG. 2B PRIOR ART
FIG. 2B is an exemplary graphical representation of signals received by the array of FIG. 2A.
Figure 3C:
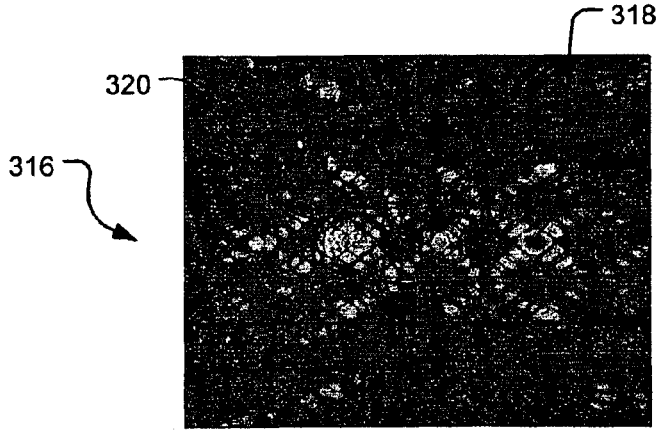
FIG. 3C is an exemplary graphical representation of signals received by the system of FIG. 3A.

Such a relationship between the spacings C, D of the transmit elements 304 and the spacings E, F of the receive elements 306 suppresses the occurrence and/or intensity of grating lobes and, thus, anomalous features, such as the anomalous feature 114 of FIG. 1C. FIG. 3C illustrates an exemplary graphical representation 316 of electromagnetic signals received by the receive elements 306. The representation 316 includes a target feature 318, which represents electromagnetic signals reflected by an object, such as the object 106 of FIG. 1B. The representation 316 further includes an anomalous feature 320; however, the intensity of the anomalous feature 320 is significantly less than that of the target feature 318.

Accordingly, the target feature 318 may be readily differentiated from the anomalous feature 320.

In one embodiment, the spacing C is equal to the spacing D and the spacing E is equal to the spacing F within manufacturing tolerances appreciated by one skilled in the art of the present invention. In one embodiment, for example, the spacings C, D correspond to a dimension of about 1.1λ, while the spacings E, F correspond to a dimension of about 3.0λ, wherein λ represents the wavelength of the signal being transmitted. In another embodiment, for example, the spacings C, D correspond to a dimension of about 1.139λ, while the spacings E, F correspond to a dimension of about 2.997λ.

Figure 4:
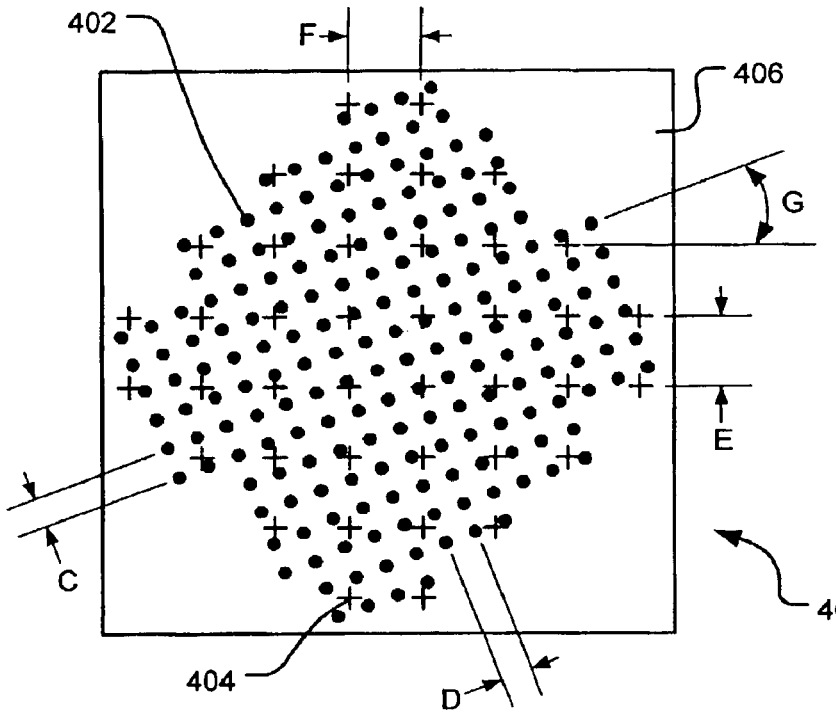
FIG. 4 is a stylized top plan view of a second embodiment of an antenna system according to the present invention.

While the transmit elements 304 and the receive elements 306 of the array 300 are illustrated in FIG. 3A as being arranged in grids that are generally parallel to each other, the present invention is not so limited. Accordingly, FIG. 4 depicts a second illustrative embodiment of an antenna system 400 according to the present invention comprising a plurality of transmit elements 402 (only one labeled for clarity) arranged in a generally orthogonal grid and a plurality of receive elements 404 (only one labeled for clarity) arranged in a generally orthogonal grid, each on a backplane 406.

However, as compared to the embodiment illustrated in FIG. 3A, the grid of the transmit elements 402 is rotated with respect to the grid of the receive elements 404 by an angle G. In various embodiments, for example, the angle G may be within a range of about zero degrees to about 45 degrees. Further, as compared to the embodiment of FIG. 3A, the perimeter geometry of the transmit elements 402 has been altered to provide transmit elements 304 proximate the receive elements 306. In other respects, elements and features of the antenna system 400 generally correspond to those of the antenna system 300 in FIG. 3A. For example, one or more of the elements 402, 404 may comprise a ring, such as the ring 308 in FIG. 3B.

Figure 5:
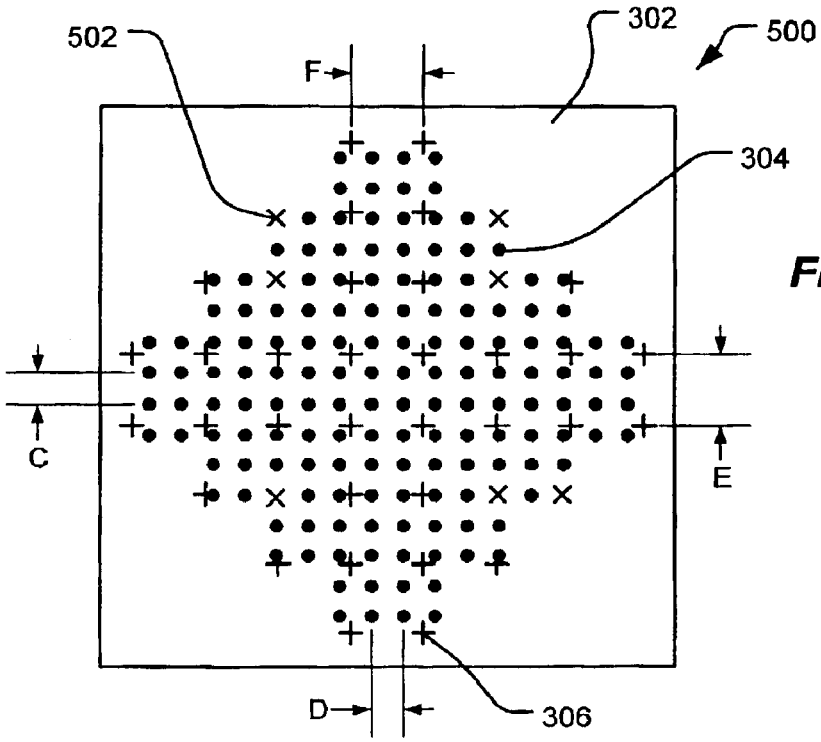
FIG. 5 is a stylized top plan view of a third embodiment of an antenna system according to the present invention.

Referring now to both FIG. 3A and FIG. 4A, depending upon the placement and spacing of the transmit elements 304, 402 with respect to the receive elements 306, 404, one or more of the transmit elements 304, 402 may be disposed close to or overlapping one or more of the receive elements 306, 404. Such a spatial relationship may cause difficulties in fabricating the antenna system 300, 400. FIG. 5 depicts a third illustrative embodiment of an antenna system 500 according to the present invention that alleviates this consequence. The antenna system 500 generally corresponds to the antenna system 300, except that some of the transmit elements 304 and the receive elements 306 that are proximate one another have been replaced with transceiver elements 502. Thus, the transceiver elements 502 are disposed proximate an intersection of the grid of the transmit elements 304 and the grid of the receive elements 306. In one embodiment, each of the transceiver elements 502 is electrically coupled to a transceiver, such as the module 314 of FIG. 3B. Further, one or more of the transceiver elements 502 may comprise a conductive ring 308, as depicted in FIG. 3B. The elements 502 may, however, take on other forms rather than that depicted in FIG. 3B.

While FIG. 5 depicts the antenna system 500 as having elements 304, 306, 502 that are arranged in a fashion generally corresponding to the elements 304, 306 of the antenna system 300 shown in FIG. 3, the present invention is not so limited. Rather, the elements 304, 306, 502 may be arranged in any chosen geometry having any chosen spacings C, D, E, F, such that neither of the spacings C, D of the elements 304, 502 is an integer multiple of either of the spacings E, F of the elements 306, 502 and neither of the spacings E, F is an integer multiple of either of the spacings C, D. In other words, the pattern resulting from convolving the grid of the transmit elements 304, 402, the grid of the receive elements 306, 404, and the grid of the transceiver elements 502 is an aperiodic pattern.

In each of the illustrative embodiments disclosed herein, the spacings C, D of the transmit elements 304. 402 are non-integer multiples of each of the spacings E, F of the receive elements 306, 404 and the spacings E, F of the receive elements 306, 404 are non-integer multiples of each of the spacings C, D of the transmit elements 304, 402. In other words, the pattern resulting from convolving the grid of the transmit elements 304, 402 and the grid of the receive elements 306, 404 is an aperiodic pattern.

Further, one or more of the spacings between the transmit elements 304, 402 may be different than the other spacings between the transmit elements 304, 402 and one or more of the spacings between the receive elements 306, 404 may be different than the other spacings between the receive elements 306, 404. In other words, the spacings between the transmit elements 304, 402 may be irregular and the spacings between the receive elements may be irregular. In such embodiments, each of the spacings between the transmit elements 304, 402 are non-integer multiples of the spacings between the receive elements 306, 404 and the spacings between the receive elements 306, 404 are non-integer multiples of the spacings between the transmit elements 304, 402. In other words, the pattern resulting from convolving the grid of the transmit elements 304, 402 and the grid of the receive elements 306, 404 is an aperiodic pattern.

Figure 6:
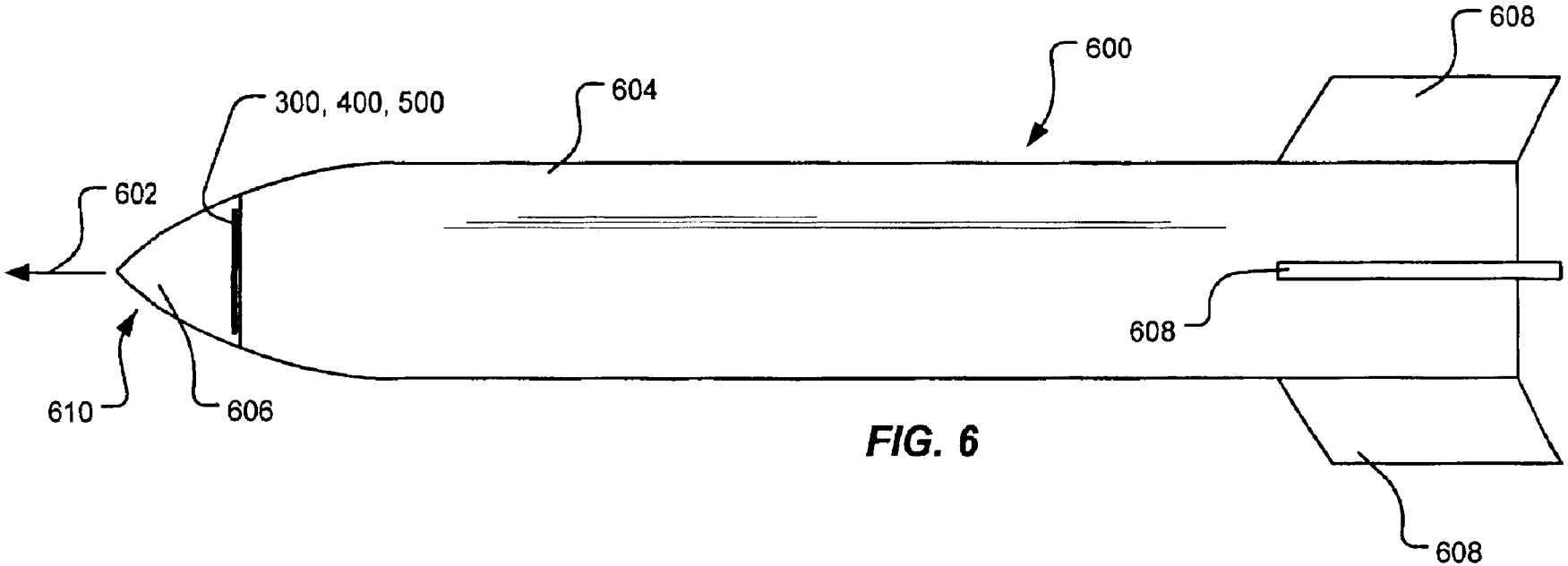
FIG. 6 is a side elevational view of a projectile according to the present invention including one of the antenna systems of FIGS. 3A, 4, and 5.

FIG. 6 depicts one particular illustrative application for the antenna system 300, 400, 500, in which the antenna system 300, 400, 500 is disposed in a projectile 600 to aid in guiding the projectile 600, while traveling in a direction generally corresponding to that indicated by an arrow 602, to a desired target (not shown). In the illustrated embodiment, the projectile 600 comprises a body 604 including a radiolucent portion 606, means for propelling the projectile 600, for example an engine, motor, or the like (not shown), and a plurality of flight control surfaces 608 for steering the projectile 600. In various embodiments, the flight control surfaces 608 may comprise, for example, fins, flares, canards, or the like. Alternatively or in addition to the flight control surfaces 608, the projectile 600 may comprise attitude control motors (not shown). The antenna system 300, 400, 500 is disposed behind the radiolucent portion 606 such that electromagnetic signals may be transmitted from the antenna system 300, 400, 500 and electromagnetic signals may be received by the antenna system 300, 400, 500 via the radiolucent portion 606.

While FIG. 6 depicts the radiolucent portion 606 as being a separate portion disposed at a nose 610 of the projectile 600, the present invention is not so limited. Rather, the radiolucent portion 606 may take on any chosen form and be disposed at any chosen location of the projectile 600.

Figure 7:
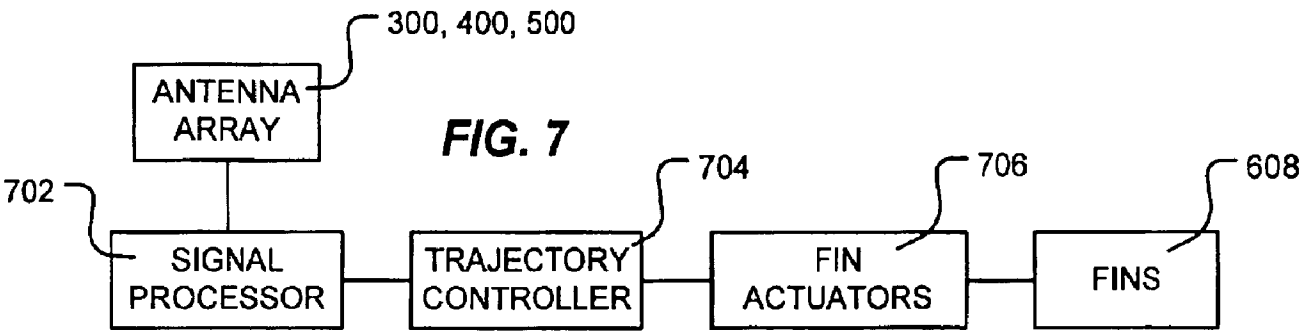
FIG. 7 is a block diagram of elements for controlling a trajectory of the projectile of FIG. 6.

In combination with the projectile 600, the antenna system 300, 400, 500 may be used, for example, to provide a signal-based image of a target in a plane generally perpendicular to the direction of travel of the projectile 600 (indicated by the arrow 602). As illustrated in FIG. 7, signals from the antenna system 300, 400, 500 may be sent to a signal processor 702 capable of determining whether the projectile 600 is on a trajectory to intersect the target. In other words, if the image of the target was not received within a desired area of the antenna system, a correction to the trajectory of the projectile 600 may be desirable. If a correction in trajectory of the projectile 600 is needed, information may be sent from the signal processor 702 to a trajectory controller 704, which may, in turn, calculate the change in trajectory needed to intersect the target, based on the information from the signal processor 702. Signals may then be sent from the trajectory controller to fin actuators 706, which then are moved to control the flight control surfaces 608 and, thus, change the trajectory of the projectile 600. Thus, by way of example and illustration, the attitude control motors (not shown) and further the actuators 706 and the flight control surfaces 608 and are means for controlling the flight path of the projectile 600.

While FIG. 7 illustrates a particular configuration of elements to control the trajectory of the projectile 600, the present invention is not so limited. Rather, the scope of the present invention encompasses various elements in any chosen configuration, along with the antenna system 300, 400, 500, to control the trajectory of the projectile 600.

The antenna system 300, 400, 500 may be used in a variety of other applications, wherein signals are transmitted and a response is received. For example, the antenna system 300, 400, 500 may be used in ground penetrating radar systems, in meteorological radar systems, in communication systems, or in other systems that transmit and receive signals.

Figure 8:
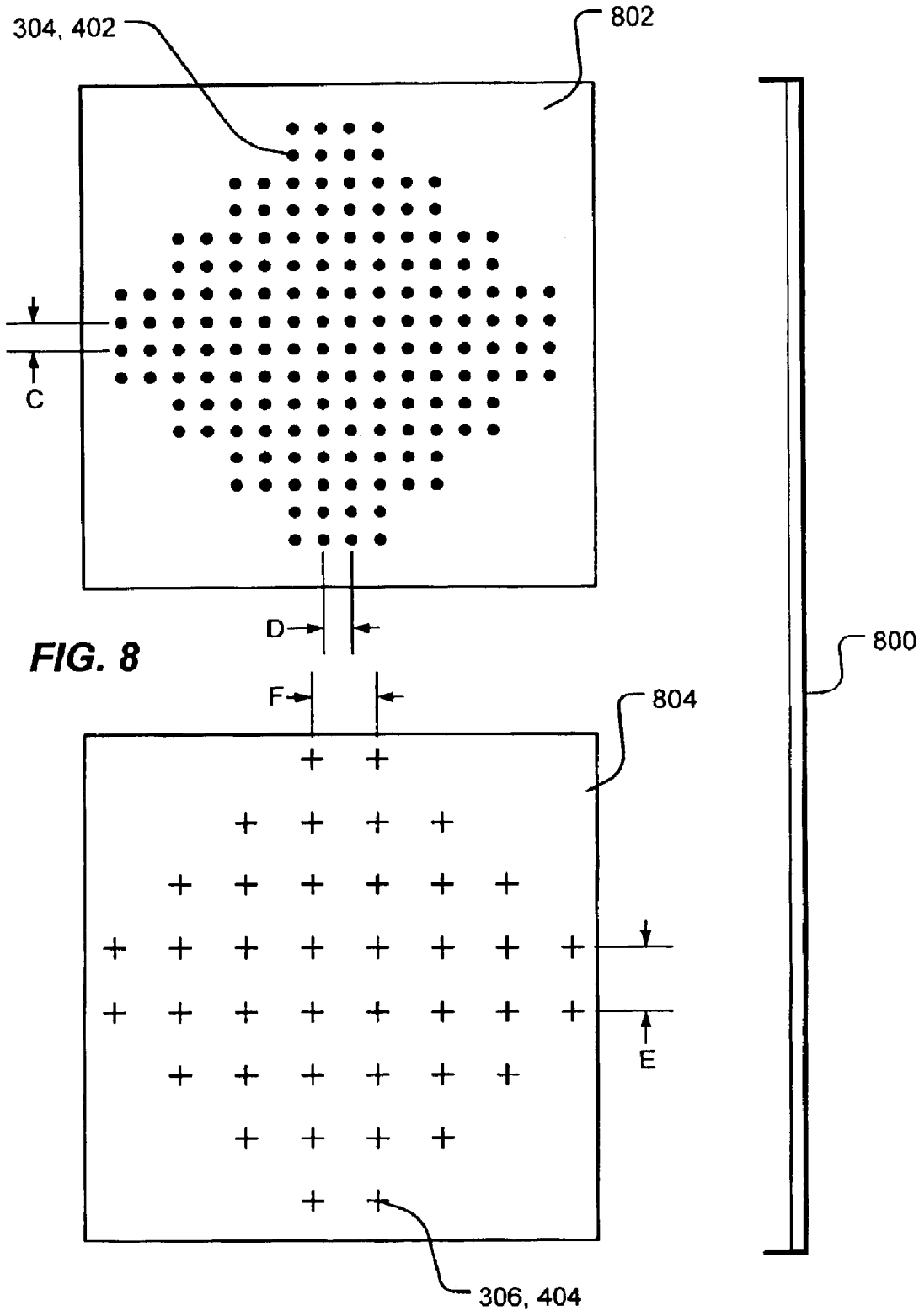
FIG. 8 is a stylized top plan view of an alternative illustrative two-backplane antenna system embodiment according to the present invention in which the transmit elements are on a first backplane and the receive elements are on a second backplane.
Figure 9:
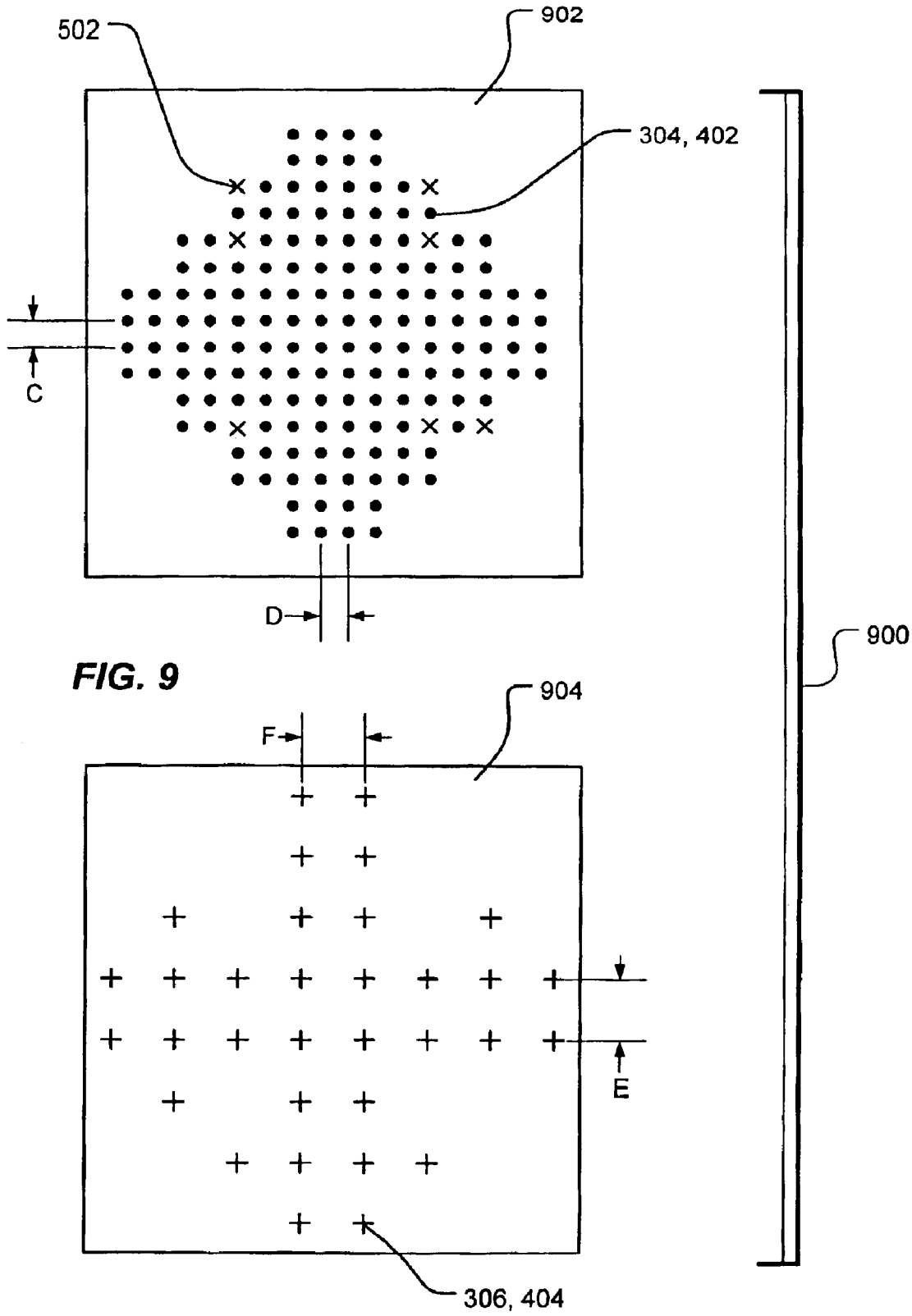
FIG. 9 is a stylized top plan view of an alternative illustrative two-backplane antenna system embodiment according to the present invention in which the transmit and transceiver elements are on a first backplane and the receive elements are on a second backplane.
Figure 10:
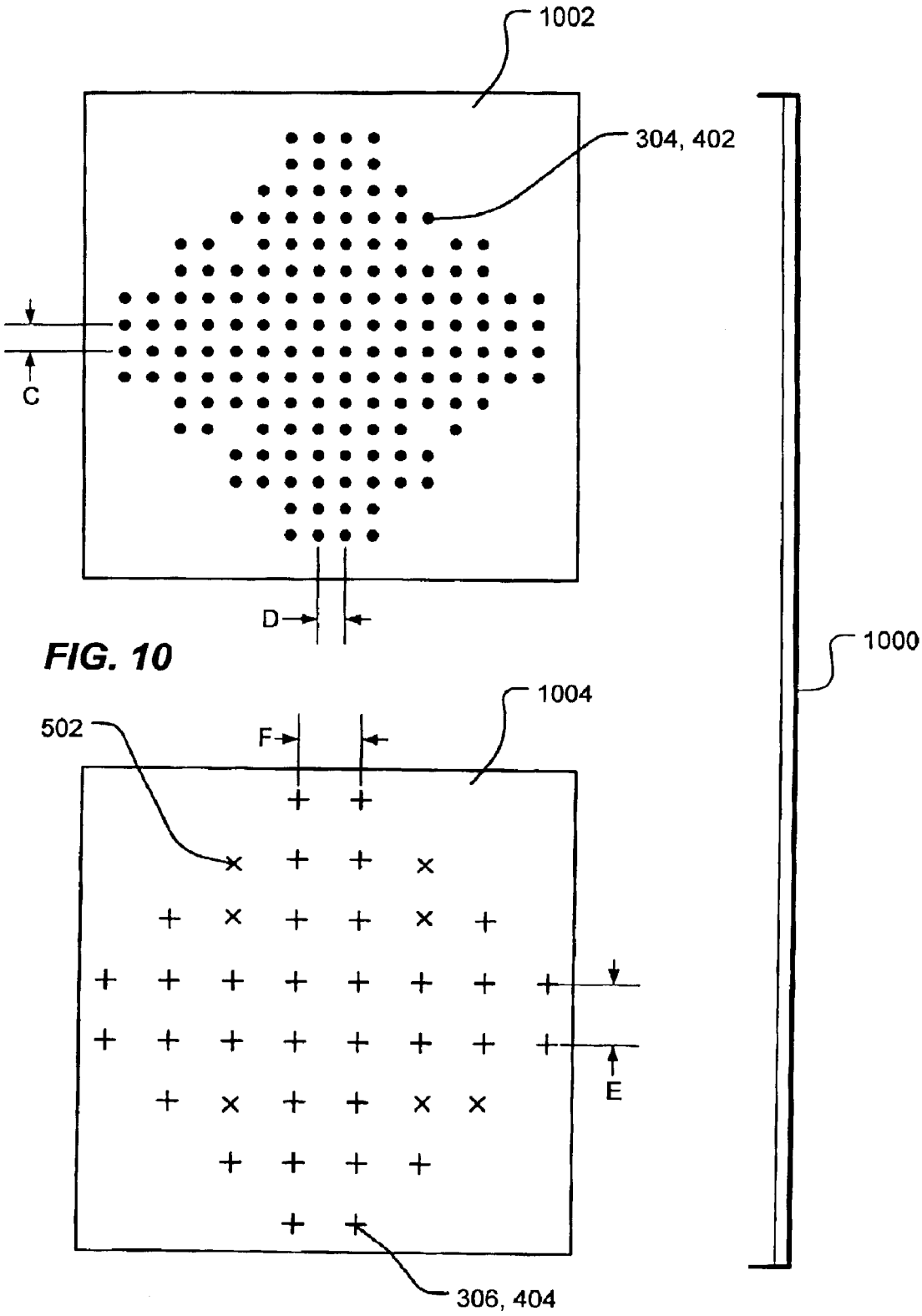
FIG. 10 is a stylized top plan view of an alternative illustrative two-backplane antenna system embodiment according to the present invention in which the transmit elements are on a first backplane and the receive and transceiver elements are on second backplane.

While the antenna system 300, 400, 500 is depicted in FIGS. 3A, 4, and 5 as comprising a single backplane (e.g., the backplane 302, 406), the present invention is not so limited. Rather, as illustrated in FIG. 8, the scope of the present invention encompasses an antenna system 800 in which the transmit elements 304, 402 are disposed on a first backplane 802 and the receive elements 306, 404 are disposed on a second backplane 804. Further, as depicted in FIG. 9, the scope of the present invention encompasses an antenna system 900 in which the transmit elements 304, 402 and the transceiver elements 502 are disposed on a first backplane 902 and the receive elements are disposed on a second backplane 904. Yet further, the scope of the present invention includes an antenna system 1000 wherein the transmit elements 304, 402 are disposed on a first backplane 1002 and the receive elements 305, 404 and the transceiver elements 502 are disposed on a second backplane 1004.

This concludes the description of the present invention. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An antenna system, comprising:

a plurality of transmit elements spaced apart by a first dimension; and a plurality of receive elements spaced apart by a second dimension, such that the first dimension is a non-integer multiple of the second dimension and the second dimension is a non-integer multiple of the first dimension.

2. An antenna system, according to claim 1, further comprising a backplane defining at least one opening therethrough and at least one of the transmit elements and the receive elements comprises an electrically conductive ring disposed around the at least one opening.

3. An antenna system, according to claim 2, further comprising one of a transmitter and a receiver and a lead electrically coupling the one of the transmitter and the receiver and the ring.

4. An antenna system, according to claim 1, wherein:

the plurality of transmit elements are spaced apart by the first dimension and a third dimension, which is different than the first dimension, in first and second orthogonal directions, respectively; and the plurality of receive elements are spaced apart by the second dimension and a fourth dimension, which is different from the second dimension, in the first and second orthogonal directions, respectively, such that the first dimension and the third dimension are non-integer multiples of each of the second dimension and the fourth dimension and the second dimension and the fourth dimension are non-integer multiples of each of the first dimension and the third dimension.

5. An antenna system, according to claim 1, wherein the first dimension is about 1.1 times a wavelength of a signal to be transmitted from the antenna system and the second dimension is about 3.0 times the wavelength of the signal to be transmitted from the antenna system.

6. An antenna system, according to claim 1, wherein the first dimension is about 1.139 times a wavelength of a signal to be transmitted from the antenna system and the second dimension is about 2.997 times the wavelength of the signal to be transmitted from the antenna system.

7. An antenna system, according to claim 1, wherein the plurality of transmit elements is arranged in an orthogonal grid and the plurality of receive elements is arranged in an orthogonal grid.

8. An antenna system, according to claim 1, further comprising a plurality of transmitters corresponding to and electrically coupled with the plurality of transmit elements.

9. An antenna system, according to claim 1, further comprising a plurality of receivers corresponding to and electrically coupled with the plurality of receive elements.

10. An antenna system, according to claim 1, further comprising a backplane on which the plurality of transmit elements and the plurality of receive elements are disposed.

11. An antenna system, according to claim 1, further comprising a first backplane on which the plurality of transmit elements are disposed and a second backplane on which the plurality of receive elements are disposed.

12. An antenna system, comprising:

a plurality of transmit elements spaced apart in a grid by a first dimension; and a plurality of receive elements spaced apart in a grid by a second dimension, such that the first dimension is a non-integer multiple of the second dimension, the second dimension is a non-integer multiple of the first dimension, and the grid of the plurality of transmit elements is rotated with respect to the grid of the plurality of receive elements.

13. An antenna system, according to claim 12, wherein the grid of the plurality of transmit elements is rotated with respect to the grid of the plurality of receive elements by an angle within a range of about zero degrees to about 45 degrees.

14. An antenna system, according to claim 12, further comprising a plurality of transmitters corresponding to and electrically coupled with the plurality of transmit elements.

15. An antenna system, according to claim 12, further comprising a plurality of receivers corresponding to and electrically coupled with the plurality of receive elements.

16. An antenna system, according to claim 12, further comprising a backplane on which the plurality of transmit elements and the plurality of receive elements are disposed.

17. An antenna system, according to claim 12, further comprising a first backplane on which the plurality of transmit elements are disposed and a second backplane on which the plurality of receive elements are disposed.

18. An antenna system, comprising:

a plurality of transmit elements spaced apart in a grid by a first dimension;

a plurality of receive elements spaced apart in a grid by a second dimension, such that the first dimension is a non-integer multiple of the second dimension and the second dimension is a non-integer multiple of the first dimension; and a transceiver element disposed proximate an intersection of the grid of the plurality of transmit elements and the grid of the plurality of receive elements.

19. An antenna system, according to claim 18, further comprising a plurality of transmitters corresponding to and electrically coupled with the plurality of transmit elements.

20. An antenna system, according to claim 18, further comprising a plurality of receivers corresponding to and electrically coupled with the plurality of receive elements.

21. An antenna system, according to claim 18, further comprising a transceiver electrically coupled with the transceiver element.

22. An antenna system, according to claim 18, further comprising a backplane on which the plurality of transmit elements and the plurality of receive elements are disposed.

23. An antenna system, according to claim 18, further comprising a first backplane on which the plurality of transmit elements are disposed and a second backplane on which the plurality of receive elements are disposed.

24. A projectile, comprising:

a body; and an antenna system disposed in the body comprising:

a plurality of transmit elements spaced apart by a first dimension; and a plurality of receive elements spaced apart by a second dimension, such that the first dimension is a non-integer multiple of the second dimension and the second dimension is a non-integer multiple of the first dimension.

25. A projectile, according to claim 24, further comprising a plurality of transmitters corresponding to and electrically coupled with the plurality of transmit elements.

26. A projectile, according to claim 24, further comprising a plurality of receivers corresponding to and electrically coupled with the plurality of receive elements.

27. A projectile, according to claim 24, the body further comprising a radiolucent portion disposed in front of the antenna system.

28. A projectile, according to claim 24, further comprising:

a signal processor for processing signals from the antenna system;

means for controlling a flight path of the projectile; and a trajectory controller coupled with the signal processor and the means for controlling the flight path, such that the trajectory controller provides an input to the means for controlling the flight path based upon, at least in part, an output of the signal processor.

29. A projectile, according to claim 28, wherein the means for controlling the flight path further comprises a plurality of actuators and a plurality of one of fins, flares, and canards.

30. A method, comprising:

transmitting a signal from a plurality of transmit elements spaced apart by a first dimension; and receiving a portion of the transmitted signal reflected from an object via a plurality of receive elements spaced apart by a second dimension, such that the first dimension is a non-integer multiple of the second dimension and the second dimension is a non-integer multiple of the first dimension.

31. A method, according to claim 30, further comprising identifying a target based upon the received signal portion.

32. A method, according to claim 31, further comprising controlling a trajectory of a projectile based at least upon the identified target.

33. An antenna system, comprising:

a plurality of transmit elements spaced apart in a first grid; and a plurality of receive elements spaced apart in a second grid, such that a convolution of the first grid and the second grid produces an aperiodic pattern.

34. An antenna system, according to claim 33, further comprising a plurality of transmitters corresponding to and electrically coupled with the plurality of transmit elements.

35. An antenna system, according to claim 33, further comprising a plurality of receivers corresponding to and electrically coupled with the plurality of receive elements.

36. An antenna system, according to claim 33, further comprising a transceiver electrically coupled with the transmit elements.

37. An antenna system, according to claim 33, further comprising a backplane on which the plurality of transmit elements and the plurality of receive elements are disposed.

38. An antenna system, according to claim 33, further comprising a first backplane on which the plurality of transmit elements are disposed and a second backplane on which the plurality of receive elements are disposed.

39. An antenna system, according to claim 33, wherein at least one of the plurality of transmit elements and the plurality of receive elements is irregularly spaced.

40. An antenna system, according to claim 33, wherein at least one of the plurality of transmit elements and the plurality of receive elements is regularly spaced.

41. An antenna system, according to claim 33, further comprising a transceiver element disposed proximate an intersection of the first grid and the second grid.

* * * * *